US005676422A

United States Patent [19]

White et al.

[11] Patent Number: 5,676,422

[45] Date of Patent: Oct. 14, 1997

[54] SLIPCOVER FOR A RECLINER

[75] Inventors: Cecil A. White, New York, N.Y.; Susan Shaner, Easton, Pa.; Gretchen F. Dale, Westport, Conn.; Clarence J. Reiss, Jr., Walnut Port, Pa.

[73] Assignee: Fieldcrest Cannon, Inc., Eden, N.C.

[21] Appl. No.: 628,906

[22] Filed: Apr. 8, 1996

[51] Int. Cl.[6] ..... A47C 27/00

[52] U.S. Cl. ..... 297/225; 297/68; 297/228.11; 297/228.13

[58] Field of Search ..... 297/68, 225, 224, 297/228.11, 229, 228.1, 219.1, 228.13, 228.12

[56] References Cited

U.S. PATENT DOCUMENTS

| | | | |
|---|---|---|---|
| Re. 24,279 | 2/1957 | Schutte et al. . | |
| Re. 25,133 | 3/1962 | Reavis et al. . | |
| 2,098,684 | 11/1937 | Fry . | |
| 2,411,915 | 12/1946 | Waranch . | |
| 2,800,169 | 7/1957 | Armbrecht | 297/225 |
| 2,811,198 | 10/1957 | Krogh | 297/225 |
| 2,820,510 | 1/1958 | Sugarman . | |
| 2,884,993 | 5/1959 | Schutte . | |
| 2,904,103 | 9/1959 | Nail | 297/224 |
| 2,921,625 | 1/1960 | Krasnov et al. | 297/224 |
| 3,116,953 | 1/1964 | Sugarman . | |
| 4,396,227 | 8/1983 | Neilson | 297/228.11 |
| 4,518,198 | 5/1985 | Daniels | 297/229 |
| 4,773,708 | 9/1988 | Nastu | 297/229 X |
| 5,549,355 | 8/1996 | Illulian | 297/225 X |

*Primary Examiner*—Milton Nelson, Jr.
*Attorney, Agent, or Firm*—Bell, Seltzer, Park & Gibson, P.A.

[57] ABSTRACT

A slipcover combination for covering a movable item of furniture having an upright and a lounging position is described. The slipcover combination has a main body panel having a substantially rectangular shape with first and second adjacent corners being notched to form a pair of substantially V-cut slits defining a panel portion therebetween for covering the pivotable foot rest of the recliner. First and second skirts are also provided, one for covering the seat main body and the other for individually covering the movable foot rest portion. The skirt for the main body is preferably in the form of a longitudinal piece of material, while the other skirt is desirably formed as a ring which fits the foot rest in the manner of a sleeve. A plurality of stay puts and spiral fasteners may also be provided. The slipcover combination can be readily be applied to a piece of furniture, and maintains its position and aesthetically appealing appearance, even as the recliner is moved from its upright position to its lounging position.

24 Claims, 3 Drawing Sheets

FIG. 4.
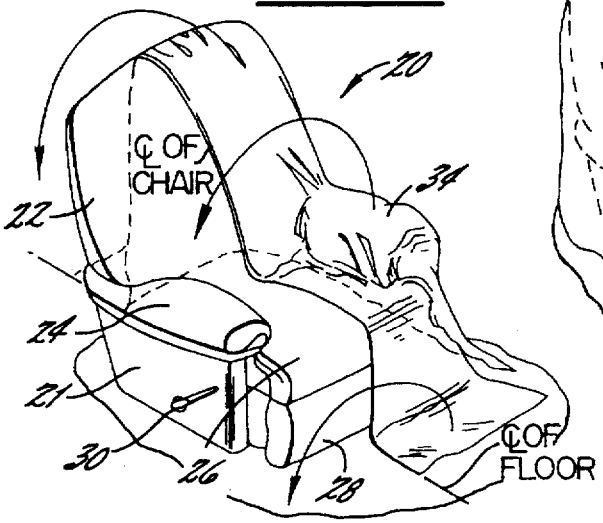
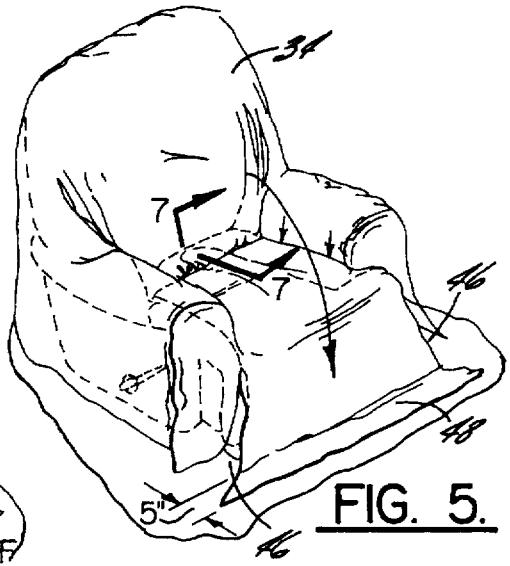
FIG. 5.
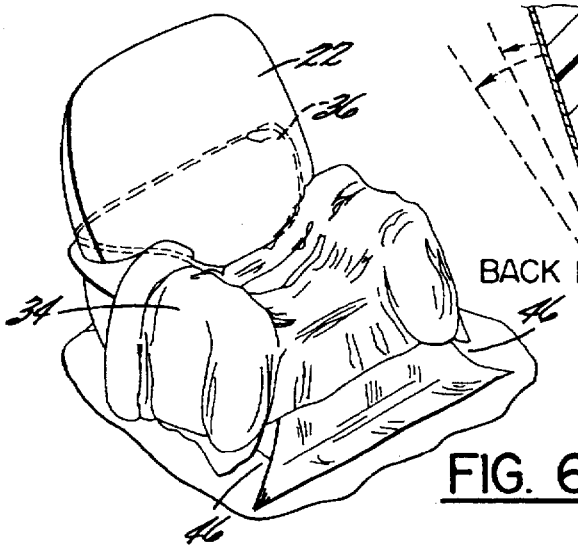
FIG. 6.
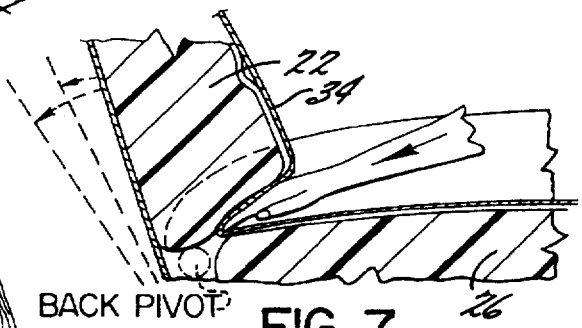
FIG. 7.
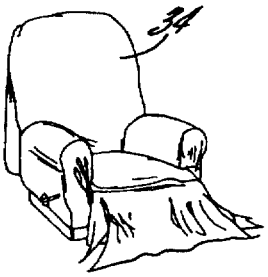
FIG. 8.
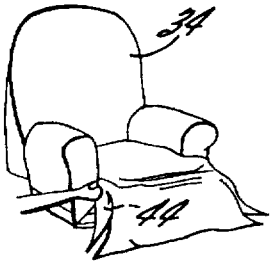
FIG. 9.
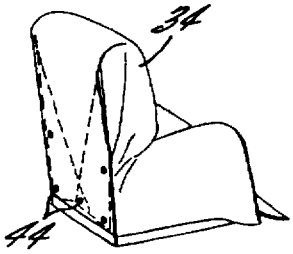
FIG. 10.

SLIPCOVER FOR A RECLINER

BACKGROUND OF THE INVENTION

1. Field of the Invention

The present invention relates generally to a slipcover for a piece of upholstered, action-type furniture, and a method for applying the same. More specifically, the invention relates to a slipcover combination for a recliner, which is easy to secure on the piece of furniture and which maintains its position on the item of furniture when the furniture is moved from an upright position to a lounging position, and a method for applying the slipcover to the reclining piece of furniture.

2. Description of the Prior Art

Slipcovers for static pieces of furniture are known in the art, and are frequently used by consumers to change the appearance of pieces of furniture. Such slipcovers are generally used to cover a piece of furniture with a different material, to cover damage such as holes or worn spots in the existing fabric of the furniture, or to hide the appearance of stains due to spills and the like. Such slipcovers historically have been custom-made to fit the item of furniture, and full-fashioned (i.e., fitted) in order that they provide the appearance of regular upholstered furniture, rather than a slipcovered appearance. Because custom-fit slipcovers tend to require a significant amount of time to produce, and their production tends to be relatively specialized, they are commonly relatively expensive. As a result, many consumers opt to reupholster or replace the furniture rather than slipcover it.

Attempts to produce prefabricated slipcovers which can be applied by the furniture owner himself have met with only limited success, because such covers typically have failed to provide an acceptable aesthetic appearance. In addition, it has heretofore been difficult to produce a slipcover which can fit a variety of shapes and configurations of furniture. Further, the covers have not been simple enough to apply to persuade many consumers to attempt the slipcovering process themselves.

Though in many cases the advantages of slipcovers have been found to outweigh their negatives, slipcovers have heretofore only been available for static pieces of furniture. Modern day quests for comfort have resulted in the advent of items of movable action-type furniture. Such pieces of furniture usually are movable from at least a first substantially upright position to a second lounging position, which is normally somewhere between the upright position and a horizontal position. These items of furniture characteristically include a lower seat front which pivots from a substantially vertical position when the seat is in its upright position and moves outwardly to a somewhat or substantially horizontal position, to support the backs of a user's legs and/or feet. (Because the lower seat front becomes a foot rest, that portion of the chair is hereinafter referred to as the "foot rest", though it is recognized that it only supports the user's legs and/or feet when in certain positions.) In addition, the seat back in many cases tilts rearwardly as well, to assume a somewhat or substantially horizontal position. Intermediate positions can also be achieved between the first and second positions, depending on the design of the seat. Further, the back tilting and foot rest moving mechanisms are ideally related, such that the motion of the various seat portions occurs simultaneously, i.e., movement of one of the seat elements causes movement of the other.

Such reclining pieces of furniture classically are operated by a handle which is often located on an outer side portion of the seat base, below one of the seat arms, in order to be readily accessible to the seat user. Alternative actuating means for moving the pieces of furniture from their upright to their reclining positions are also known, such as push-button electronic or hydraulic systems or the like. Additionally, though originally reclining pieces of furniture were in the form of wing or arm seats (i.e. single user chairs), the concept has now been expanded to encompass multi-user pieces of furniture such as sofas, where individual sections are now selectively reclinable. Thus, as used herein, the term "seat" is meant to encompass both single and multi-user reclining pieces of furniture.

Typically, when a reclining seat is moved from its substantially upright position to the lounging position, the foot rest pivots outwardly from its substantially vertical position to assume a substantially horizontal position for supporting the back of the user's legs and feet. Though referred to as having a substantially horizontal position when the recliner is in the lounging position, the foot rest can assume a variety of positions between the substantially vertical position (when the seat is in its upright position) to a substantially or slightly greater than horizontal position (i.e., a slightly upright position), provided the foot rest is pivoted sufficiently outward to provide a support for the user's legs and/or feet. The foot rest, when in its leg supporting position, is commonly supported by a mechanism located underneath the recliner foot rest. The mechanism usually includes bars which extend outwardly from beneath the seat, and are controlled by an operating handle on the side of the seat. In many reclining pieces of furniture, this mechanism also operates the rearward tilting motion of the seat back so that the back tilts rearwardly as the foot portion extends outwardly.

Because the reclining pieces of furniture are generally some of the most comfortable in a person's house, they often are the most frequently used, which hastens their tendency to become soiled and damaged. Further, because the seats move from a first substantially upright to a second substantially horizontal position, users are often more likely to spill food and drinks during the motion of the seat than they might be when sitting in a static piece of furniture. In addition, the location of the foot rest when the recliner is in its lounging position tends to invite the user to rest or support his feet thereon; therefore this portion can be rapidly soiled and/or damaged. Thus, it appears that these pieces of furniture, which historically have been excluded from the ranks of the slipcovered, are the items which could most greatly benefit from the slipcovering process.

Typical slipcover constructions, such as those described in U.S. Pat. Nos. 2,800,169, 3,116,953, and Re. 25,133 to Armbrecht, Sugarman and Reavis, et al. respectively, are unacceptable for use in combination with action-type pieces of furniture such as recliner seats, because they fail to allow for the pivoting motion and extension of the foot rest. As illustrated in each of these patents, the portion of each of their respective slipcovers which covers the lower front portion of the seat extends continuously around the side of the seat. Thus, if one were to apply a slipcover such as the ones described in these patents to a piece of action-type furniture, the footrest would be restrained from making its outward pivoting motion. Because the movement of the foot rest portion of a reclining seat is often directly associated with that of the seat back tilting rearwardly, the back of the seat would thus be likewise hindered from motion. The result with the slipcovers described by each of the above-referenced patents would be a slipcovered seat that will not assume the lounging position, or a torn slipcover.

U.S. Pat. No. Re. 24,279 to Schutte et al. describes a slipcover for covering a sofa which is adapted to convert into a bed. As illustrated in FIG. 1 of that patent, the portion of the slipcover which covers the lower front of the sofa extends around the sofa arms and terminates proximate the side of the sofa, in a manner similar to the aforementioned patents. Thus, this slipcover would also hinder the pivoting motion of the foot rest portion of the seat, in the same manner as the slipcovers described above.

U.S. Pat. No. 2,884,993, also to Schutte, describes a slipcover for a sofa which is convertible to a bed. In this slipcover design, the seat cushions are individually covered such that a skirt extends from a lower portion of each seat cushion cover. In this way, the covered cushion and corresponding skirt can be removed and the sofa can be unfolded to form a bed. Elastic tapes having hooks at their ends are used to secure a main body portion of the slipcover to the sofa. There is no provision, however, for forming the sofa into a bed while the entire slipcover is still in place on the piece of furniture.

Thus, a need exists for a slipcover combination which allows for the slipcovering of a piece of action-type reclining furniture. Further, a need exists for a slipcover combination which maintains its position and appearance on the item of furniture throughout the reclining motion, and which is readily and easily applied to the piece of furniture by the consumer.

SUMMARY OF THE INVENTION

With the foregoing in mind, it is an object of the present invention to provide a slipcover for a movable piece of action-type furniture such as a recliner seat.

It is a further object of the present invention to provide a slipcover which can be easily applied to a piece of furniture, and which maintains its aesthetically appealing appearance throughout the use of the seat, including its motion from a first substantially upright position to at least a second lounging position where the foot rest pivots outwardly to support the back of the legs and/or feet of the seat user.

These and other objects, features and advantages are provided by a slipcover combination for a movable piece of furniture such as a reclining seat, having a base, a back, first and second arms, a seat cushion, and a foot rest which pivots from a substantially vertical position when the seat is in an upright position to at least a second lounging position in which the foot rest pivots outwardly to a substantially or somewhat horizontal position. The seat also desirably includes an operating handle for activating the seat's motion from this first position to the second position. Other intermediate positions can also be attained, depending on the design of the seat. It will be noted, however, that the invention can be applied to various shapes of reclining furniture other than the precise one illustrated, and that movement of the foot rest to its leg supporting position can be performed by means other than the operating handle, such as an electronic activation means or hydraulic means, or simply by the user applying rearward pressure to the seat back.

The slipcover combination desirably includes a main body panel, a main body skirt, and a foot rest skirt, and may also include an elastic band, a plurality of "stay puts", and a plurality of spiral fasteners. It is noted, however, that other types of fasteners could be utilized within the scope of the invention.

The main body panel is preferably substantially rectangular, and includes first and second substantially V-shaped slits proximate two adjacent corners thereof, defining a foot panel section therebetween which has first and second pointed end portions. The main body panel is preferably made from a piece of flexible, drapable material such as upholstery fabric, simulated or natural animal skin, sheet-type plastic, or the like.

Each of the main body and foot rest skirts desirably has an upper band portion for securement to the recliner, and a free hanging portion. In a preferred form of the invention, the free hanging portions are gathered at their respective upper band portions in order to provide a gathered skirt for the slipcovered recliner. It is also noted that a substantially straight hanging (i.e., boxed) or pleated skirt, or the like, could also be used within the scope of the present invention. The main body skirt is desirably formed as a longitudinal piece of material, whereas the foot rest skirt desirably has its respective ends sewn or otherwise secured together, to form a substantially ring-shaped skirt. In a particularly preferred form of the invention, the upper band of each of the skirts and particularly that of the foot rest skirt, is elasticized, in order that the skirts can closely conform to the seat body to which they are attached. Each of the skirts is desirably made from the same type material as is used to form the main body panel, i.e., a flexible, drapable material such as upholstery fabric, simulated or natural animal skin, sheet-type plastic, or the like.

In a preferred form of the invention, the main body skirt includes a slit which is adapted to correspond to the operating handle of the recliner when the main body skirt is secured around the seat. Alternative means such as an opening or the like could also be provided to correspond with the operating mechanism for the seat, within the scope of the invention. In this way, the skirt is kept from being hitched up proximate the handle, and a more custom-fit appearance is provided.

The elastic band preferably includes an elastic strap portion having a fabric catching hook secured to either end thereof. Though hooks are suggested as a preferred means for grasping the slipcover material, it is noted that other grasping elements could be used such as clamps, pins, or the like. The entire band is preferably elastic, though it is noted that it could be formed to have both elastic and inelastic sections.

Securement of the slipcover combination to a recliner is preferably performed as follows: the main body panel is desirably draped over the piece of furniture to be covered and centered thereon, such that the V-shaped slits are positioned proximate the foot rest, and the main body panel extends onto the floor in front of the seat, preferably by at least about five inches. The main body panel is then tucked into crevices between the seat cushion and the seat back and arms.

The portion of the main body panel which extends over the back of the recliner is then desirably folded forward toward the seat cushion. The tucked portions of the main body panel are then desirably secured in position behind the seat cushion by clipping the hooks or the like of the elastic band thereto such that the elastic band extends around the back side of the seat back. This elastic band assists in maintaining the main body panel in position on the recliner when the recliner is moved from its substantially upright position to its reclined lounging position. The main body panel is then returned to its position where it covers both front and rear portions of the seat back. Any excess material of the main body panel is then desirably tucked into the crevices between the seat cushion and the seat back and arms. The elastic band is covered by the main body panel such that it is hidden from sight, thereby providing a neat appearance to the covered seat.

The material of the main body panel is then desirably gathered, tucked and secured proximate the seat arms. In a preferred method of the invention, the material is secured in position by spiral fasteners. These types of fasteners have been found to be particularly useful because they are easy to install on the furniture, do not tend to unduly damage the material of the slipcover, tend to stay in their secured positions and are not unduly obtrusive. The material can be secured in a variety of positions, to achieve a variety of different appearances. For example, the material can be fingerpleated or simply folded flat and secured. In this way, the consumer is enabled to customize the appearance of his covered seat to meet his personal tastes.

Any loose material of the main body panel which remains proximate the rear of the seat back is then desirably gathered, tucked, and secured, preferably by way of spiral fasteners. For example, the material can be finger pleated and secured, or smoothed flat for a more tailored appearance.

The foot rest of the recliner is then desirably positioned in its reclined substantially or somewhat horizontal position, and the pointed end portions of the foot panel section are wrapped around the sides of the foot rest. The pointed end portions are desirably pulled through the space between the foot rest and the operating mechanism located beneath the foot rest portion, and the pointed end portions are desirably tied together, pinned, or otherwise secured beneath the foot rest. The material of the foot panel section which extends from the lower outermost extending edge of the foot rest is then desirably secured beneath the foot rest, such as by spiral fasteners or the like.

Beginning at one end thereof, a first end of the main body skirt is then secured to an inside of the seat base proximate one of the seat arms by way of a spiral fastener or the like. The main body skirt is then wrapped around the side and back of the seat and bound to the other side of the seat base, proximate the other arm, where it is secured to an inside portion thereof in the same manner as the first end of the main body skirt.

The foot rest skirt is then desirably placed on the foot rest in an encircling fashion. In a preferred form of the invention, the foot rest skirt is in the form of an elasticized ring and the elasticized ring is simply stretched, placed over the foot rest in the manner of a sleeve, and released. In this embodiment, at least an upper band portion of the main body skirt is also desirably elasticized, in order that a consistent appearance is provided by both the main body and foot rest skirts. The foot rest is then desirably returned to its substantially vertical upright position, and the heights of the skirts are adjusted and leveled such that they extend to a desired length with relation to the floor. The skirts can then be supplementally secured, such as by additional spiral fasteners or the like.

A plurality of "stay puts" may be positioned within the crevices between the seat cushion and the seat arms and back. The "stay puts," which are characteristically cylindrically shaped pieces of cardboard, plastic, metal, or the like, assist in maintaining the main body panel in position on the recliner, particularly throughout the use of the seat and its movement from its upright to its lounging position.

Other objects, features and advantages of the present invention will become apparent from the following detailed description when taken in conjunction with the accompanying drawings, in which like numerals indicate like elements throughout.

BRIEF DESCRIPTION OF THE DRAWINGS

FIG. 4 is a perspective view of a slipcover main body panel according to the present invention folded lengthwise and centered on a recliner seat;

FIG. 5 is a perspective view of a slipcover main body panel according to the present invention being tucked into the crevices between the seat cushion and the seat arm and back of a recliner;

FIG. 6 is a perspective view of the slipcover main body panel illustrated in FIG. 5, as it appears with a back portion folded forwardly and with an elastic strap secured thereto;

FIG. 7 is a sectional view illustrating a user re-tucking a slipcover main body portion into the crevice between the recliner back and seat cushion;

FIGS. 8–9are perspective views of a slipcover main body panel according to the present invention as it appears while being secured about the arm portions of the seat;

FIG. 10 is a rear perspective view illustrating one method of securing excess fabric of the main body panel of a slipcover combination according the present invention to the rear back of a recliner;

DETAILED DESCRIPTION OF THE PREFERRED EMBODIMENTS

Figure 1:
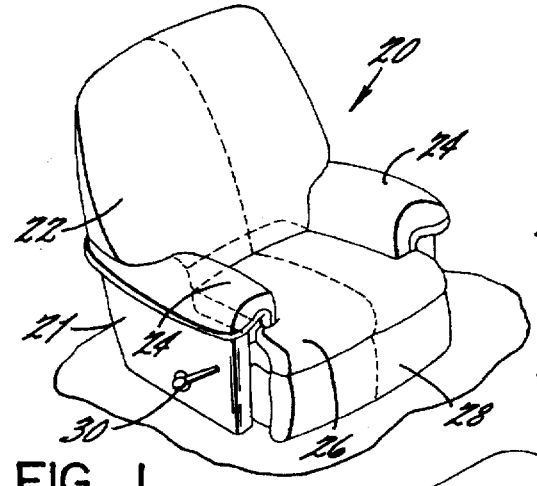
FIG. 1 is a perspective view of a typical recliner seat.
Figure 2:
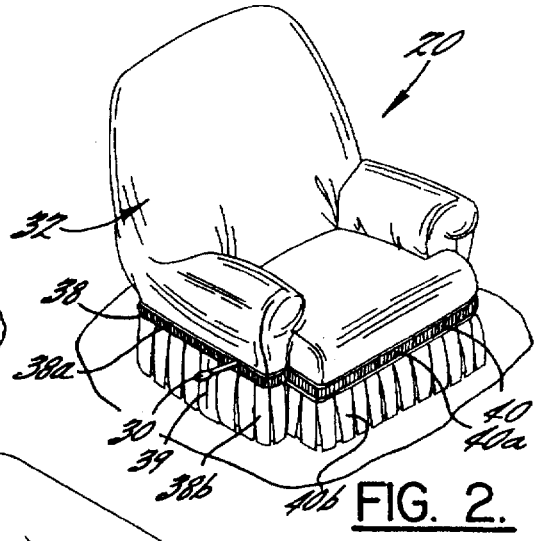
FIG. 2 is a perspective view of a typical recliner seat as it appears when covered with a slipcover combination according to the present invention.

With reference to the drawings, FIG. 1 illustrates a conventional recliner 20 as it appears before being slipcovered, and FIG. 2 illustrates the same recliner as it appears with a slipcover combination 32 according to the present invention secured thereon. The recliner 20 desirably includes a base 21, a back 22, arm portions 24, a seat cushion 26, and a foot rest 28. The foot rest 28 can be pivoted outwardly from its substantially vertical upright position to a substantially horizontal leg supporting position, preferably by actuating operating handle 30. It will be noted, however, that the invention can be applied to various shapes of reclining furniture other than the precise one illustrated, and that movement of the foot rest 28 to its leg supporting position can be performed by means other than the operating handle 30, such as an electronic activation means or hydraulic means, or simply by the user applying rearward pressure to the seat back 22. Further, it is noted that the recliner 20 can be designed such that the foot rest 28 extends to various positions, preferably ranging between the substantially vertical position when the seat is in its upright configuration, to a somewhat or substantially horizontal position or slightly greater than horizontal position (i.e., tilted slightly upward), provided the foot rest can support a user's lower legs and/or feet.

Figure 3:
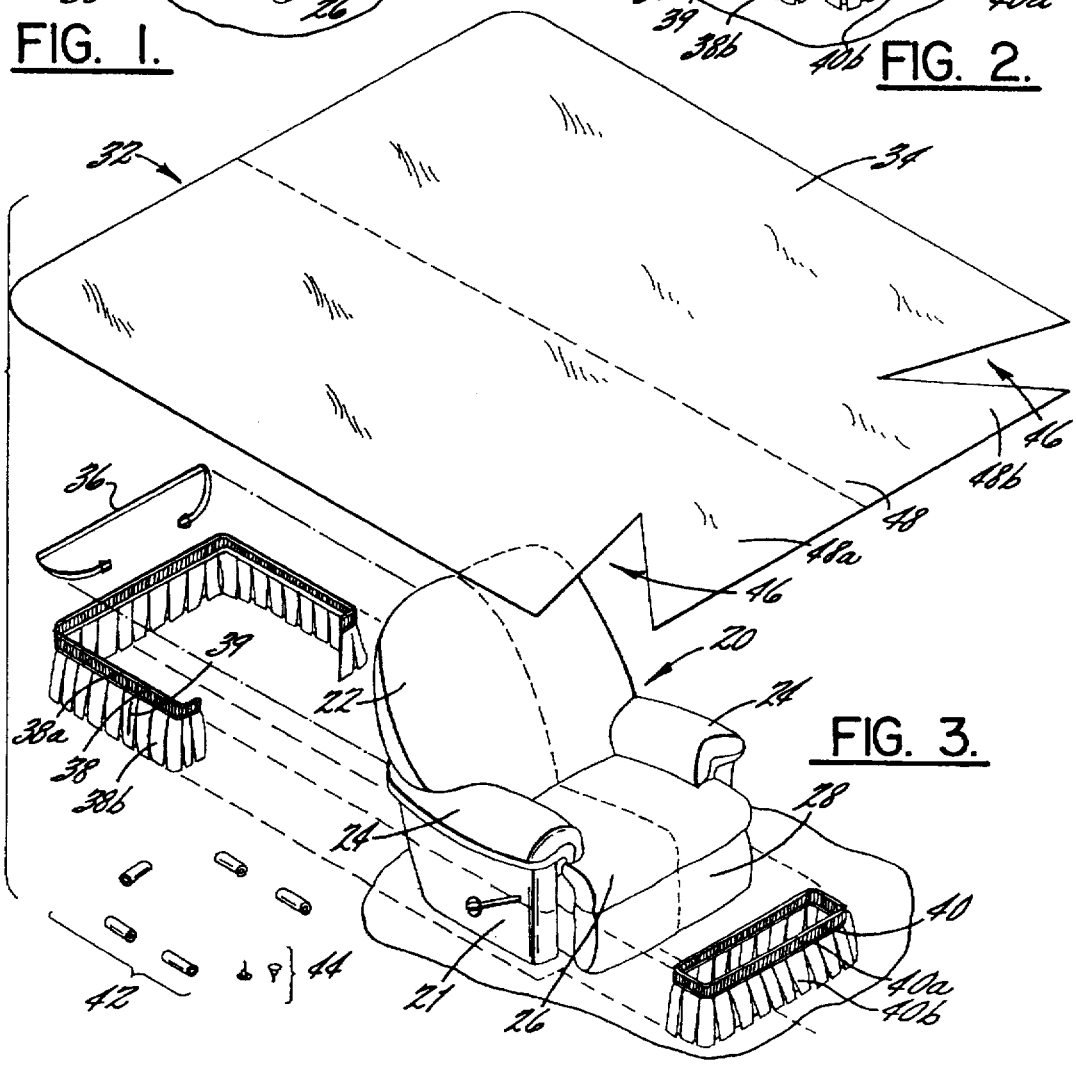
FIG. 3 is an exploded perspective view of a recliner and a slipcover combination according to the present invention, illustrating the parts and accessories supplied therewith.
Figure 11:
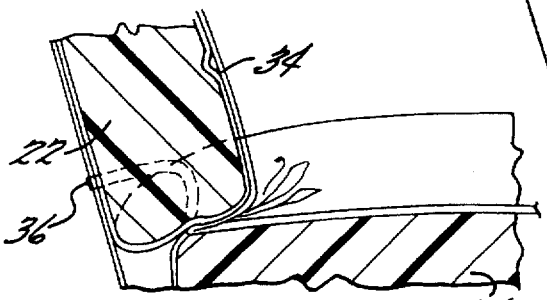
FIG. 11 is a sectional view similar to that shown in FIG. 7, illustrating an elastic strap as it appears tucked within the crevice between the seat cushion and back of recliner.
Figure 12:
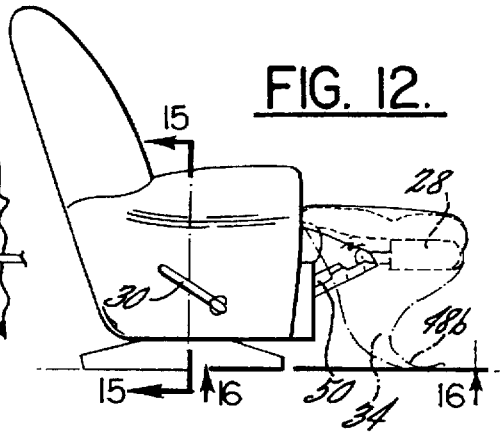
FIG. 12 is a side elevational view of the recliner shown in FIG. 1 as it appears in a reclined or lounging position and showing the foot rest supporting mechanism and with the main body panel of a slipcover according to the present invention hanging therefrom.
Figure 13:
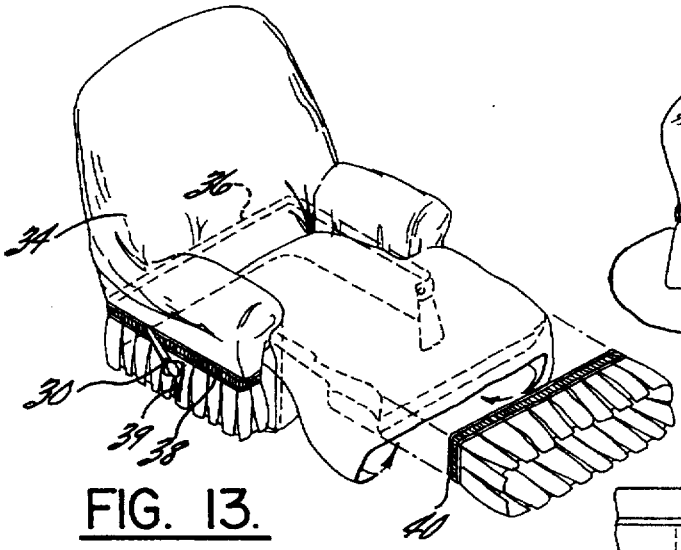
FIG. 13 is a partially exploded view illustrating the recliner of FIG. 12 as it appears with a main body skirt according to the present invention secured around the main seat body and a foot rest skirt according to the present invention as it is being positioned on the foot rest.
Figure 14:
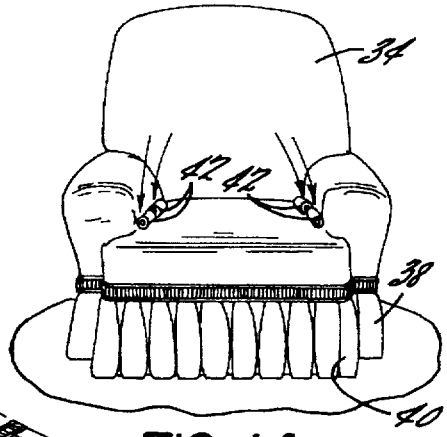
FIG. 14 is a front perspective view of a slipcover according to the present invention as it appears when positioned on a recliner, and as a plurality of "stay puts" are being secured within the crevices between the seat arm portions and seat cushion.
Figure 15:
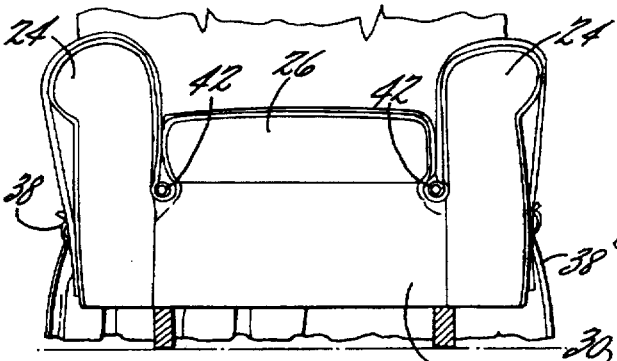
FIG. 15 is a sectional view taken along line 15—15 of FIG. 12, illustrating the positions of the "stay puts" within the crevices between the recliner arm portions and the seat cushion.
Figure 16:
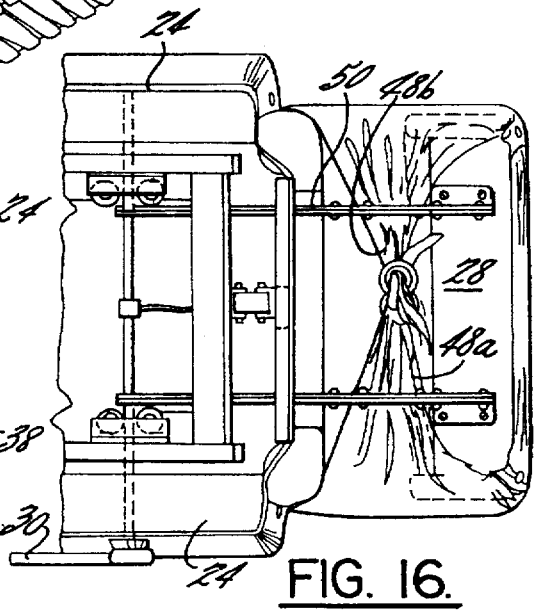
FIG. 16 is an inverted plan view of the foot rest of the refiner as shown along line 16—16 of FIG. 12, illustrating two ends of the main body panel of a slipcover according to the present invention as they appear when tied above the foot rest operating mechanism.

The slipcover combination 32 is illustrated in FIG. 3, as it appears prior to being secured to a recliner 20. In one form of the invention, the slipcover combination 32 includes a main body panel 34, an elastic band 36, a main body skirt 38, a foot rest skirt 40, a plurality of "stay puts" 42, and a plurality of spiral fasteners 44. It is noted, however, that other types of fasteners could be utilized within the scope of the invention.

The main body panel 34 is preferably substantially rectangular, and includes first and second substantially V-shaped slits 46 proximate two adjacent corners thereof, defining a foot panel section 48 therebetween which has first and second pointed end portions 48*a*, 48*b*. Though the main body panel 34 is illustrated as being adapted for use in combination with a single user-type item of furniture, it is noted that the main body panel could be widened for use with wider seats, such as one adapted to accommodate two seated users. The main body panel 34 is preferably made from a piece of flexible, drapable material such as upholstery fabric, simulated or natural animal skin, sheet-type plastic, or the like. In a preferred form of the invention adapted to fit a single-user seat, the V-shaped slits 46 extend inwardly from the sides and bottom, respectively, of the main body panel 34 from about 1/7 to 1/3 of the total main body panel width, and from about 1/8 to 1/4 of the total main body panel length.

The elastic band 36 preferably includes an elastic strap portion having a fabric catching hook secured to each end thereof. Though hooks are the preferred securement means, it is noted that other conventional types of fasteners could be used, such as alligator clamps, clips, pins or the like, provided they are able to graspingly receive the main body panel 34. Though the entire band 36 is preferably formed entirely of elastic material, it is noted that the band could have elastic and inelastic sections.

Each of the main body and foot rest skirts 38, 40 desirably has an upper band portion 38*a*, 40*a* for securement to the recliner 20, and a free hanging skirt portion 38*b*, 40*b*. In a preferred form of the invention, the skirt portions 38*b*, 40*b* are gathered at their respective upper band portions 38*a*, 40*a* in order to provide a gathered skirt for the slipcovered recliner. It is also noted that a substantially straight hanging (i.e., boxed) or pleated skirt, or the like, could also be used within the scope of the present invention.

The main body skirt 38 is desirably formed as a longitudinal piece of material, whereas the foot rest skirt 40 desirably has its respective ends sewn or otherwise secured together, to form a substantially ring-shaped skirt. In a particularly preferred form of the invention, the upper band of each of the skirts 38, 40, and particularly that of the foot rest skirt 40, is elasticized, in order that the skirts can closely conform to the recliner body portion to which they are attached. The skirts 38, 40 can be elasticized by sewing an elastic band (not shown) thereto, by sewing elasticized threads in their respective upper bands 38*a*, 40*a*, or in a conventional manner. Each of the skirts 38, 40 is desirably made from the same material as is used to form the main body panel 34, i.e., a flexible, drapeable material such as upholstery fabric, simulated or natural animal skin, sheet-type plastic, or the like. Though the skirts 38, 40 also desirably are made of the same fabric or material pattern as that of the main body panel 34, it is noted that various combinations of materials could be used within the scope of the invention.

In a preferred form of the invention, the main body skirt 38 includes a slit 39 which is adapted to correspond to the operating handle 30 of the recliner 20. Alternative means such as an opening or the like could also be provided to correspond with the operating mechanism for the seat, within the scope of the invention. In this way, when the main body skirt 38 is secured about the seat body, the skirt is not caused to be hitched up by the handle 30; rather it can hang freely around the handle, thereby providing an uninterrupted skirt lower edge and hence, a more custom-fit appearance.

Securement of the slipcover combination 32 to a recliner such as that shown at 20 in FIG. 1 is preferably performed in the manner illustrated in FIGS. 4–16. As shown in FIG. 4, the main body panel 34 is desirably centered longitudinally over the recliner 20, such that the V-shaped slits 46 are positioned proximate the foot rest 28, and the main body panel extends onto the floor in front of the seat. In a preferred form of the invention, the main body panel 34 is sized and positioned such that at least about five inches of the foot panel section 48 extends onto the floor in front of the recliner. As illustrated in FIG. 5, the main body panel 34 is then tucked into crevices between the seat cushion 26 and the seat back 22 and arms 24.

As illustrated in FIG. 6, the portion of the main body panel 34 which extends over the back 22 of the recliner 20 is then desirably folded forward toward the seat cushion 26. The tucked portions of the main body panel 34 are then desirably secured in position behind the seat cushion 26 by clipping the hooks or other fastener elements of the elastic band 36 thereto such that the elastic band extends around the rear of the seat back 22. This elastic band 36 assists in maintaining the main body panel 34 in position on the recliner 20 (see FIG. 11) when the recliner is moved from its substantially upright position to its reclined lounging position.

The main body panel 34 is then returned to its position covering both front and rear portions of the seat back 22. Any excess material of the main body panel 34 is then desirably tucked into the crevices between the seat cushion 26 and the seat back 22 and arms 24, as illustrated in FIG. 7. As illustrated in the drawings, the elastic band 36 is covered by the main body panel 34 such that it is hidden from sight, thereby providing a neat appearance to the covered seat.

The material of the main body panel 34 is then desirably gathered, tucked and secured proximate the seat arms 24. In a preferred method of the invention, the material is secured in position by spiral fasteners 44. The material can be secured in a variety of positions, to achieve a variety of differing appearances. For example, the material can be fingerpleated and secured, to achieve a less formal look, as illustrated in FIG. 8. Alternatively, the material can be folded flat and secured, to achieve a more tailored appearance, as shown in FIG. 9. In this way, the consumer is enabled to customize the appearance of their covered seat to meet their personal tastes.

Any loose material of the main body panel 34 which remains proximate the rear of the seat back 22 is then desirably gathered, tucked, and secured, preferably by way of spiral fasteners 44. For example, the material can be finger pleated and secured, or smoothed flat for a more tailored appearance.

The foot rest 28 of the recliner 20 is desirably positioned in its reclined somewhat or substantially horizontal position, and the pointed end portions 48*a*, 48*b* of the foot panel section 48 are wrapped around the sides of the foot rest. The pointed end portions 48*a*, 48*b* are desirably pulled through the space between the foot rest 28 and the operating mechanism 50 located beneath the foot rest, and the pointed end portions are desirably tied together, pinned, or otherwise secured beneath the foot rest. The material of the foot panel section 48 which extends from the foot rest 28 is then desirably secured beneath the foot rest, such as by spiral fasteners 44 or the like.

Beginning at one end thereof, the main body skirt 38 is secured to an inside of the seat base 21 proximate one of the seat arms 24 by way of a spiral fastener 44 or the like, wrapped around the seat base, and secured to the other side of the seat base, proximate an inside of the other seat arm.

The foot rest skirt 40 is then desirably placed on the foot rest 28 in an encircling fashion. In a preferred form of the invention where the foot rest skirt 40 has an elasticized upper end, this securement is particularly easily performed, as the elasticized ring is simply stretched, placed over the foot rest 28, and the tension released, such that the skirt grips the foot rest. The foot rest 28 is then desirably returned to its substantially vertical upright position, and the heights of the skirts 38, 40 are desirably checked to see that they are level with each other. When the leveling is completed, the foot rest skirt 40 can be further secured to the respective recliner portions such as by spiral fasteners 44 or the like. The main body skirt 38 is desirably adjusted so that the slit 39 is aligned with the operating handle 30 of the recliner 20. In this way, the main body skirt is enabled to extend continuously around the recliner 20 without being hitched up by the handle 30. The main body skirt 38 can then be further secured into position by way of spiral fasteners 44 or the like.

A plurality of "stay puts" 42 may then be positioned within the crevices between the seat cushion 26 and the seat arms 24. The "stay puts" 42 may assist in maintaining the main body panel 34 in position on the recliner 20, particularly throughout the use of the seat and its movement from its upright to its lounging position. In this way, the piece of furniture is securely slipcovered, and the cover maintains its aesthetically appealing appearance throughout movement of the seat from its upright position to its lounging position.

In the drawings and specification, there has been set forth a preferred embodiment of the invention, and although specific terms are employed, they are used in a generic and descriptive sense only and not for purposes of limitation, the scope of the invention being defined in the claims.

That which is claimed is:

1. A slipcover combination for a reclining piece of furniture having a main body and a foot rest which is movable from a first substantially vertical upright position to a second generally horizontal leg supporting position comprising:

a flexible substantially rectangular main body panel having first and second adjacent corners notched inwardly toward the center of the panel to define first and second substantially V-shaped slits and a foot panel section therebetween, a main body skirt for encircling a lower main body of a piece of furniture, and a foot rest skirt for individually covering a foot rest portion of a piece of furniture.

2. The slipcover combination according to claim 1, wherein said foot rest skirt is substantially ring-shaped, to enable it to substantially encircle the foot rest of a piece of furniture.

3. The slipcover combination according to claim 2, wherein said foot rest skirt has an elasticized upper edge.

4. The slipcover combination according to claim 1, further comprising a plurality of fasteners for securing said main body panel to the main body of a piece of furniture.

5. The slipcover combination according to claim 1, further comprising a plurality of stay puts for securing said main body panel to the main body of a piece of furniture about a seat cushion portion thereof.

6. The slipcover combination according to claim 1, further comprising an elastic band having fastening members cooperating with opposite ends thereof, said elastic band being adapted to secure a portion of said main body panel about a rear portion of a piece of furniture.

7. The slipcover combination according to claim 6, further comprising a plurality of fasteners for securing said main body panel to the main body of a piece of furniture and a plurality of stay puts for securing said main body panel to the main body of a piece of furniture about a seat cushion portion thereof.

8. The slipcover combination according to claim 1, wherein said substantially V-shaped slits extend toward a center region of said main body panel about ⅛ to ¼ of the length of the main body panel and about ⅐ to ⅓ of the width of the main body panel.

9. A slipcover combination according to claim 1, wherein said main body skirt includes an opening for receiving an operating handle of a reclining piece of furniture.

10. A slipcover and seat combination comprising:

a seat having a main body including a base, back, first and second arms and a seat cushion therebetween, and a foot rest which is movable from a first substantially vertical upright position to a second generally horizontal leg supporting position, a flexible substantially rectangular slipcover main body panel having first and second adjacent corners notched inwardly toward the center of the panel to define first and second substantially V-shaped slits and a foot panel portion therebetween, said main body panel being positioned over said seat such that said foot panel portion covers said foot rest and is secured therebehind, and a remainder of said main body panel substantially covers at least said back and seat cushion of said seat, a main body skirt secured to the base of said seat proximate a lower portion thereof, and a foot rest skirt secured on said foot rest to cover at least an outwardly facing portion thereof.

11. The slipcover and seat combination according to claim 10, wherein said foot rest skirt is substantially ring-shaped and it substantially encircles the foot rest.

12. The slipcover and seat combination according to claim 11, wherein said foot rest skirt has an elasticized upper edge which maintains the foot rest skirt on said foot rest.

13. The slipcover and seat combination according to claim 10, further comprising a plurality of fasteners securing said main body panel to the main body of said seat.

14. The slipcover and seat combination according to claim 10, further comprising a plurality of stay puts positioned on top of said main body panel and between said first and second seat arms and seat cushion to secure said main body panel to the main body of the seat.

15. The slipcover and seat combination according to claim 10, further comprising an elastic band having fastening members cooperating with opposite ends thereof, said elastic band being secured to opposite sides of said main body panel proximate said seat back to secure the main body panel smoothly thereabout.

16. The slipcover and seat combination according to claim 15, further comprising a plurality of fasteners securing said main body panel to the main body of the seat and a plurality of stay puts securing said main body panel to the main body of the seat about the seat cushion thereof.

17. A slipcover and seat combination according to claim 10, wherein said seat includes an operating handle for actuating movement of said foot rest, and said main body skirt includes an opening for receiving the operating handle.

18. A method of slipcovering a reclining piece of furniture having a main body and a foot rest which is movable from a first substantially vertical upright position to a second generally horizontal leg supporting position, said method comprising the steps of:

positioning a flexible substantially rectangular main body panel having first and second adjacent corners notched inwardly to define first and second substantially V-shaped slits and a foot panel section therebetween over the reclining piece of furniture such that said foot panel section covers the foot rest and is secured thereto and a remainder of said main body panel substantially covers at least a back and seat cushion of said piece of furniture, then securing a main body skirt to the base of said piece of furniture proximate a lower portion thereof, and securing a foot rest skirt on said foot rest to cover at least an outwardly facing portion thereof.

19. The method according to claim 18, further comprising the step of securing said main body panel to the piece of furniture by inserting a plurality of fasteners through the main body panel and into the piece of furniture.

20. The method according to claim 18, further comprising the step of positioning a plurality of stay puts on top of the main body panel and about a seat cushion portion of the piece of furniture to secure the main body panel about the seat cushion thereof.

21. The method according to claim 18, further comprising the step of securing an elastic band having fastening members cooperating with its opposite ends to said main body panel about a rear portion of the piece of furniture to secure the main body panel thereon.

22. The method according to claim 21, further comprising the steps of securing said main body panel to the piece of furniture by inserting a plurality of fasteners through the main body panel and into the piece of furniture and positioning a plurality of stay puts on top of the main body panel and about a seat cushion portion of the piece of furniture to secure the main body panel about the seat cushion thereof.

23. A slipcover combination for a reclining piece of furniture having a main body and a foot rest which is movable from a first substantially vertical upright position to a second generally horizontal leg supporting position comprising:

a flexible substantially rectangular main body panel having first and second adjacent corners notched inwardly toward the center of the panel to define first and second substantially V-shaped slits and a foot panel section therebetween, a main body skirt for encircling a lower main body of a piece of furniture, said main body skirt having an opening for receiving an operating handle of the piece of furniture, a substantially ring-shaped foot rest skirt having an elasticized upper edge for individually covering a foot rest portion of a piece of furniture, a plurality of fasteners for securing said main body panel to the main body of a piece of furniture, and an elastic band having fastening members cooperating with opposite ends thereof.

24. The slipcover combination according to claim 23, wherein said substantially V-shaped slits extend toward a center region of said main body panel about ⅛ to ¼ of the length of the main body panel and about ⅐ to ⅓ of the width of the main body panel.

* * * * *